US009528288B2

(12) United States Patent
Fleury

(10) Patent No.: US 9,528,288 B2
(45) Date of Patent: Dec. 27, 2016

(54) MULTIPLE ORIENTATION POOL SKIMMING NET WITH THREE-POINT LEVERAGING CONFIGURATIONS

(71) Applicant: Luc Fleury, Montreal (CA)

(72) Inventor: Luc Fleury, Montreal (CA)

( * ) Notice: Subject to any disclaimer, the term of this patent is extended or adjusted under 35 U.S.C. 154(b) by 263 days.

(21) Appl. No.: 13/757,850

(22) Filed: Feb. 3, 2013

(65) Prior Publication Data

US 2014/0217010 A1 Aug. 7, 2014

(51) Int. Cl.

| | |
|---|---|
| ***E04H 3/16*** | (2006.01) |
| ***E04H 4/16*** | (2006.01) |
| *C02F 1/00* | (2006.01) |

(52) U.S. Cl.

CPC ..... *E04H 4/1609* (2013.01)

(58) Field of Classification Search

USPC 16/231, 233, 235, 236; 209/417; 210/167.1, 232, 238, 241, 470

See application file for complete search history.

(56) References Cited

U.S. PATENT DOCUMENTS

| | | | | |
|---|---|---|---|---|
| 2,804,637 | A | 9/1957 | Antozak | |
| 4,369,109 | A * | 1/1983 | Edge | 210/167.19 |
| 4,822,487 | A | 4/1989 | Soich | |
| 4,846,972 | A | 7/1989 | Anderson | |
| 6,383,374 | B1 | 5/2002 | Splendorio | |
| D553,862 | S | 10/2007 | Gregg | |
| 7,761,949 | B1 | 7/2010 | Hughes, IV | |
| 7,984,811 | B2 | 7/2011 | Gonzalez | |
| 2004/0108259 | A1 | 6/2004 | Gianantonio | |
| 2006/0016047 | A1 * | 1/2006 | Blackman et al. | 16/231 |
| 2011/0012007 | A1 * | 1/2011 | Brewer | 248/514 |

FOREIGN PATENT DOCUMENTS

| | | |
|---|---|---|
| CA | 1310157 | 11/1992 |
| DE | 894837 | 10/1953 |
| EP | 0430846 | 6/1991 |

* cited by examiner

*Primary Examiner* — Dirk Bass
*Assistant Examiner* — Hayden Brewster

(57) ABSTRACT

An improved pool skimming net apparatus has a net member including a frame and a net held by the frame. The frame has parallel elongated top and bottom frame portions, an elongated handle member pivotally attached to the top frame portion by an articulated joint member, an elongated retainer member pivotally attached to the top frame portion at a distance from the articulated joint member, a handle clamp member attached to a distal end of the retainer member and adapted to releasably hold a portion of the handle member, and a secondary handle clamp member fixedly attached to the top frame portion at a distance from the articulated joint member and adapted to releasably hold a portion of the handle member, such that when the handle member is held by the handle clamp member an acute angle is formed between the handle member and the top frame portion.

4 Claims, 5 Drawing Sheets

MULTIPLE ORIENTATION POOL SKIMMING NET WITH THREE-POINT LEVERAGING CONFIGURATIONS

This application claims priority based on request GB1201944.4 filed Feb. 3, 2012

FIELD OF THE INVENTION

The present invention relates generally to to pool equipment but more particularly to a pool skimming net apparatus.

BACKGROUND OF THE INVENTION

Using a skimming net to pick up debris on the water surface of a swimming pool is well known. There are two main types of swimming pools: in-ground and above ground. When skimming an in-ground pool, the net is placed slightly below ground level to reach the water surface and as such, the user holds the skimmer's handle downwardly. When skimming an above ground pool, the user obviously need to hold the handle differently depending on how high the pool is and how short the user is. Because of the two different orientations of the handle, the skimming net may not be adequate or optimized for both situations.

SUMMARY OF THE INVENTION

In view of the foregoing disadvantages inherent in the known devices now present in the prior art, the present invention, which will be described subsequently in greater detail, is to provide objects and advantages which are:

To provide for an improved swimming pool skimming net which has an adjustable net that can be oriented into a variety of different angles in relation to the handle.

In order to do so, the invention has a handle member connected to a skimming net member by way of an articulated joint member. The articulated joint member is connected to a primary frame member interface. The primary frame member interface extends perpendicularly from a circumferential frame member portion. The skimming net member consists in a frame member formed by the circumferential frame member portion, and at least one cross support member connected between a top portion and a bottom portion of the circumferential frame member portion. A net member is attached to and located within the frame member's periphery. The handle member pivots from a substantially parallel configuration in relation to the frame member, to a substantially acute angle thereof. A retainer member sets any angle in between the parallel and set acute angle configurations, also providing a secondary attachment point between the frame member, and the handle member by way of a retainer pivot point member extending integrally from the circumferential frame member portion. The primary frame member interface is located approximately a third of the way onto the top portion of the circumferential frame member portion, and the retainer pivot point member is located approximately two thirds of the way onto the top portion of the circumferential frame member portion so as to provide a separating space between the primary frame member interface and the retainer pivot point member both located on the circumferential frame member portion as well as a separating space on the handle member between the articulated joint member and a resiliently deformable friction clamp member, located at a distal end of the retainer member and releasably connected onto the handle member by way of the resiliently deformable friction clamp member.

The pool skimming net has the handle member is attached onto a handle clamp member which is fixedly connected to the circumferential frame member portion.

The retainer member is clipped onto the frame member by way of a retainer clip member.

The handle member is preferably telescopic in configuration.

The handle member is disconnected from the retainer member and reconnected to the handle clamp member and change in configuration has the pool skimming net change from an above ground pool optimized configuration into an in ground pool optimized configuration.

The cross support member being used for strengthening the frame member so as to reduce undue warping of a net member.

The separating space between the primary frame member interface and the retainer pivot point member providing leverage so as to reduce torsion stress onto the articulated joint member, as well as spreading load caused by water friction onto two points on the handle member.

DETAILED DESCRIPTION OF THE PREFERRED EMBODIMENT

Figure 1:
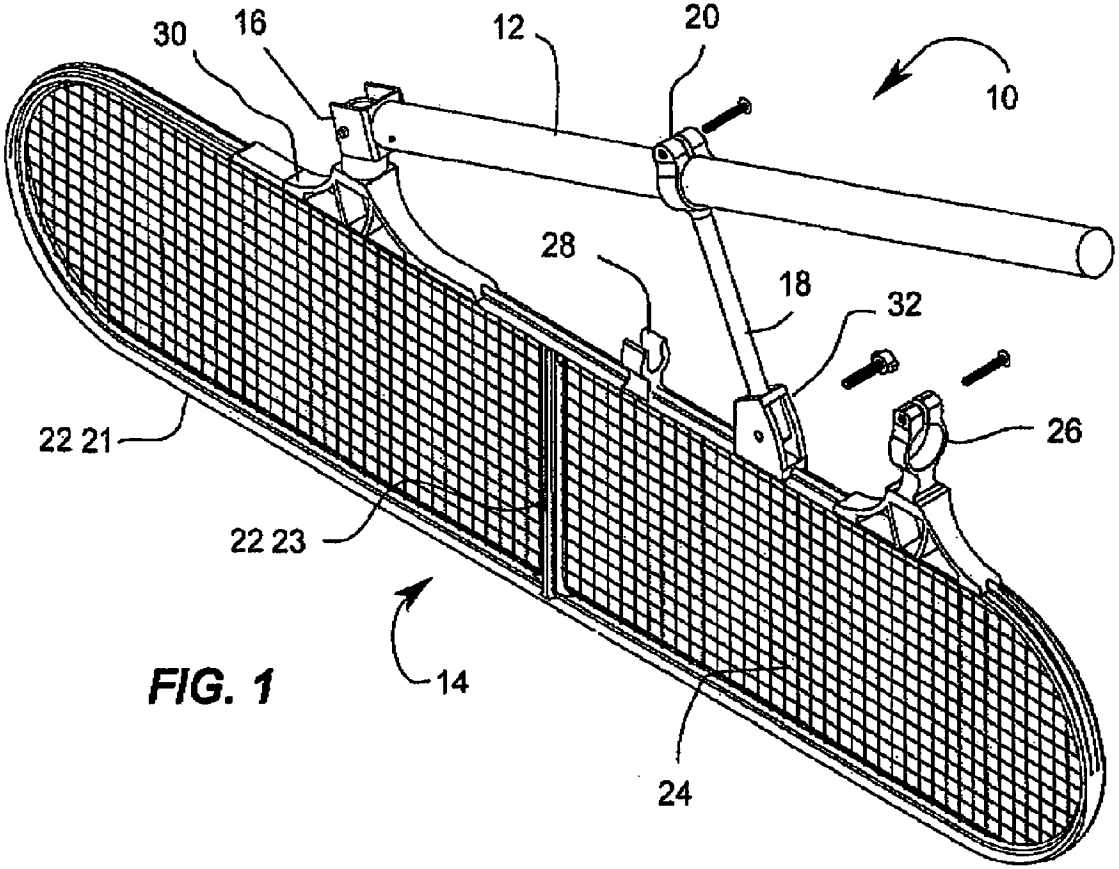
FIG. 1 Isometric view of the invention.
Figures 2A, 2B, 2C, 2D:
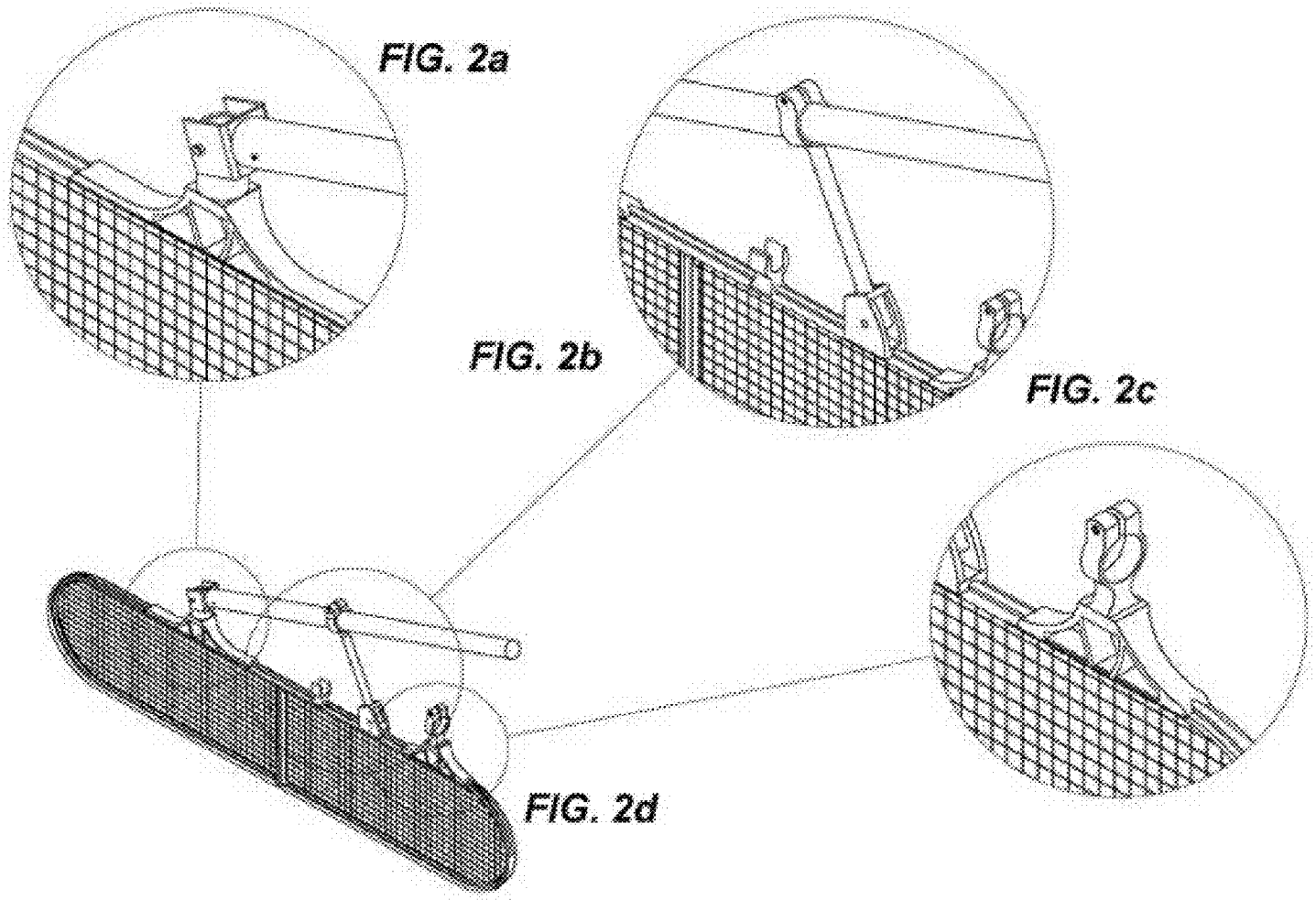
FIGS. 2*a-d* Isometric view of the Invention as well as detail elements.
Figure 3C:
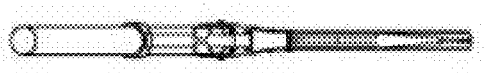
FIGS. 3*a-c* Top front and side views of the invention.
Figure 3A:
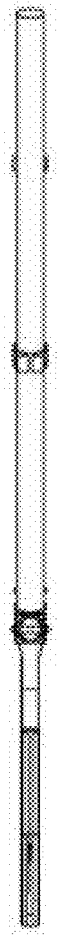
Figure 3B:
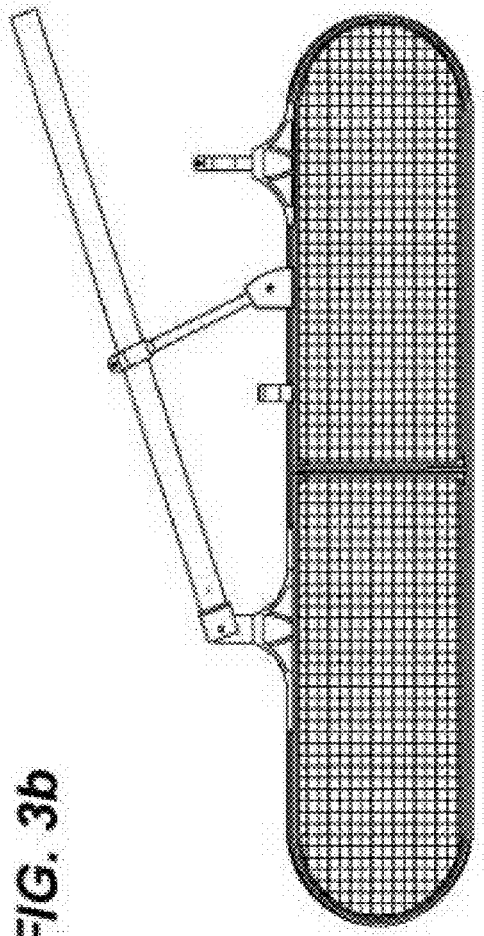

A pool skimming net (10) has a circumferential frame member (22), and a net member, (24) located within the circumferential frame member (22) and the circumferential net member (22) has a distal end (21) and a proximal end (25), both the distal and proximal ends (21, 25) are located on an upper portion of the circumferential frame member (22). A first point of attachment is defined by an articulated joint member (16) generally located one third across the length of the circumferential frame member (22) relative to the distal end (21), and a second point of attachment defined by a retainer member pivot point (29) located generally two third across the length of the circumferential frame member (22) relative to the distal end (21); a third point of attachment defined by a handle clamp member (26) located at the proximal end (25). The articulated joint member (16) is rotationally attached to a handle member (12). A retainer member pivot point (29) is rotationally attached to a retainer member (18), and the retainer member (18) is slidingly connected to the handle member (12) by way of a resiliently deformable friction clamp member (20). The handle clamp member (26) is also resiliently deformable so that it can releasably connect the handle member (12) when the handle member (12) is in a configuration that is substantially parallel to the circumferential frame member (22) and disengages the handle member (12) when the handle member (12) is in an acute angle configuration relative to the circumferential frame member (22). The articulated joint member (16), and the retainer member pivot point (29), along with the retainer member (18) form a three point triangular leveraging configuration to hold the circumferential frame member (22) when the handle member (12) is in a substantially acute angle configuration relative to the circumferential frame member (22), and a three point linear leveraging configuration to hold the circumferential frame member (22) when the handle member (12) is in a substantially parallel configuration relative to the circumferential frame member (22).

The retainer member (18) is clipped onto the circumferential frame member (22) by way of a retainer clip member (28).

The handle member (12) is preferably telescopic in configuration.

The handle member (12) is disconnected from the retainer member (18) and reconnected to the handle clamp member (26) and change in configuration as the pool skimming net (10) changes from an above ground pool optimized configuration into an in ground pool optimized configuration.

A cross support member (23) is used for strengthening the circumferential frame member (22) so as to reduce undue warping of the net member (24).

Figure 4:
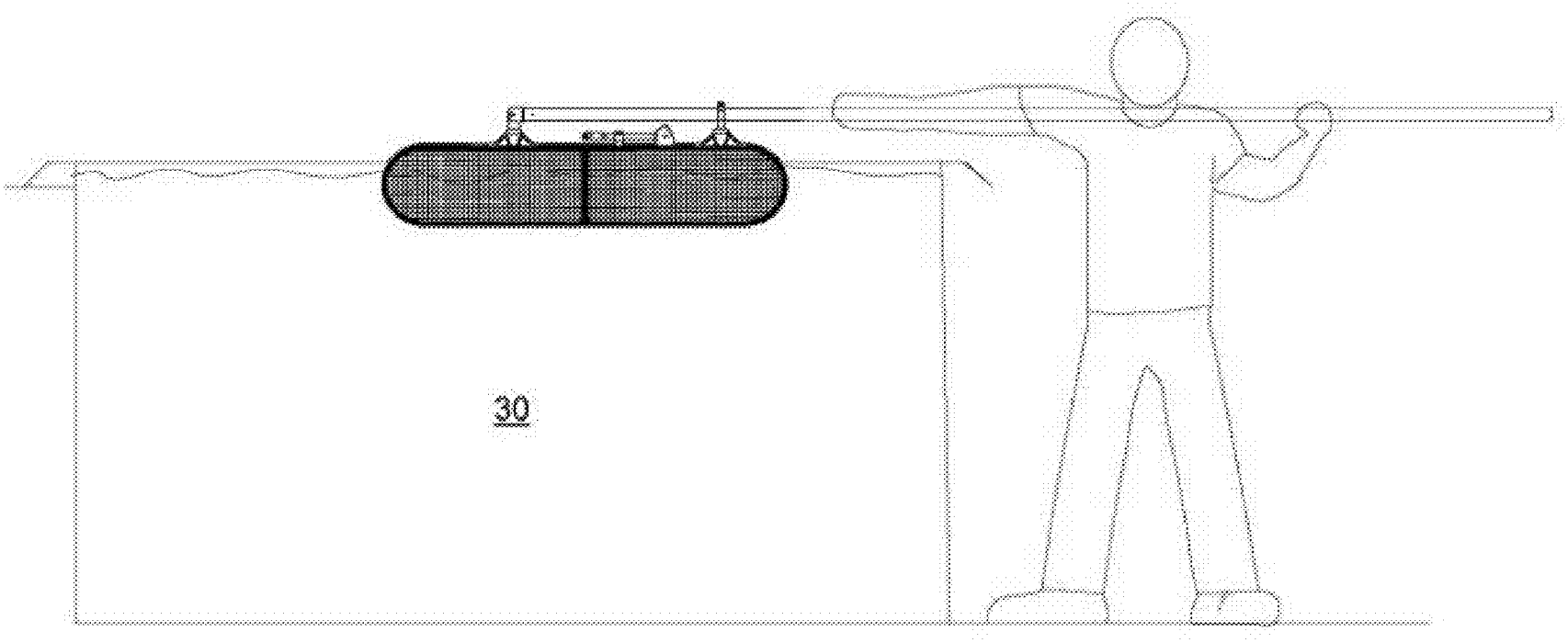
FIG. 4 Side elevation of the invention in use in an above ground pool.
Figure 5:
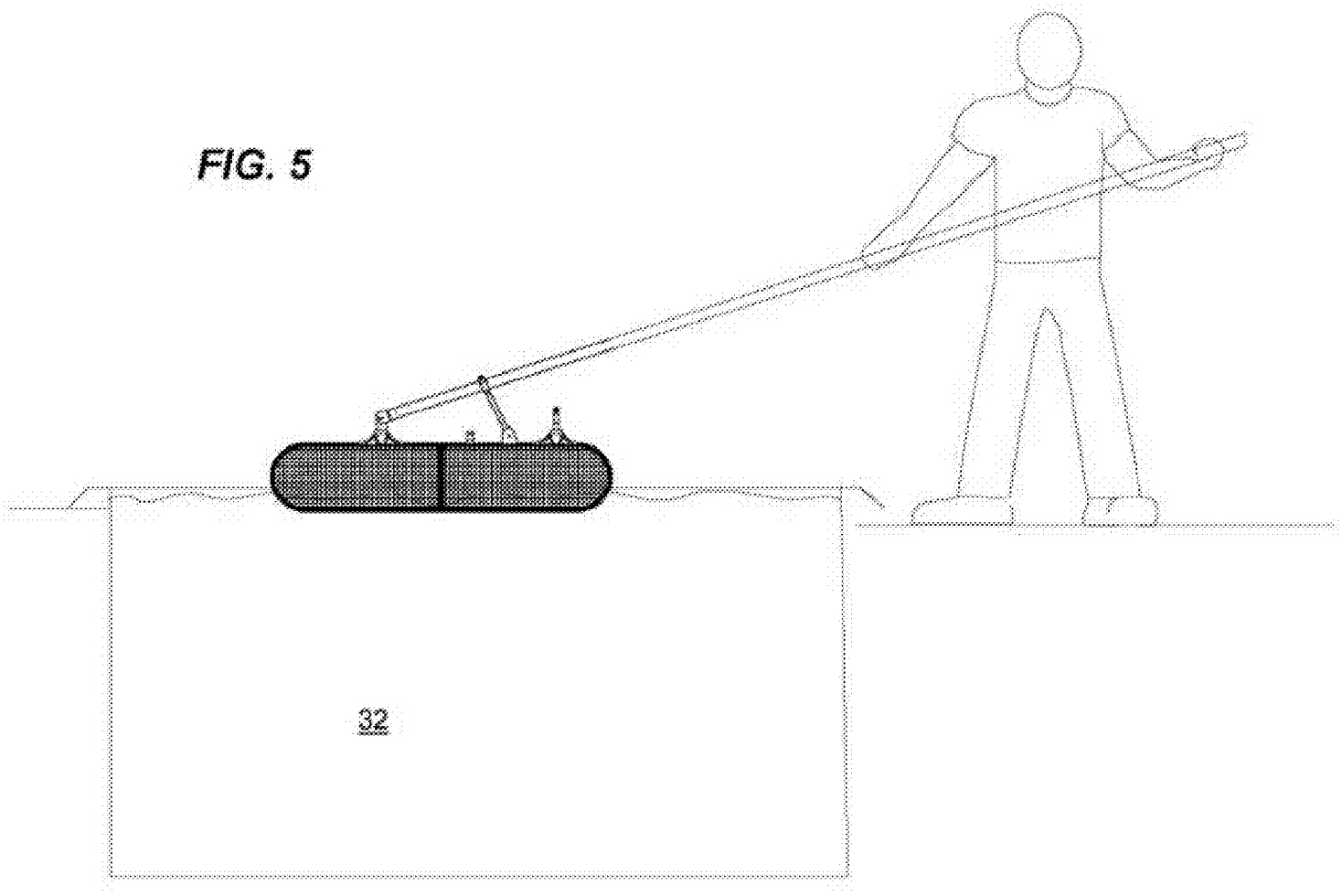
FIG. 5 Side elevation of the invention in use in an in-ground pool.

In use, the skimming net (10) can switch from one configuration for an above ground pool (30), as shown in FIG. 4, to another configuration for an in ground pool (32), as shown in FIG. 5, simply by disconnecting the handle member (12) from the retainer member (18) and connecting it to the handle clamp member (26).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A pool skimming net having a circumferential frame member, and a net member located within said circumferential frame member wherein said circumferential net member has a distal end and a proximal end located respectively across a length of an upper portion of said circumferential frame member, a first point of attachment defined by an articulated joint member generally located one third of the way across a length of said circumferential frame member relative to said distal end, and a second point of attachment defined by a retainer member pivot point located generally two thirds of the way across said length of said circumferential frame member relative to said distal end, and a third point of attachment defined by a handle clamp member located generally at said proximal end of said circumferential frame member, said articulated joint member being rotationally attached to a handle member, said retainer member pivot point being rotationally attached to a retainer member, and said retainer member being slidingly connected to said handle member by way of a resiliently deformable friction clamp member, said handle clamp member also being resiliently deformable so that it releasably connects to said handle member when said handle member is in a configuration that is substantially parallel to said circumferattial frame member and disengages said handle member when said handle member is in an acute angle configuration relative to said circumferential frame member, wherein said articulated joint member, and said retainer member pivot point, and said retainer member form a three point triangular leveraging configuration to hold said circumferential frame member when said handle member is in a substantially acute angle configuration relative to said circumferential frame member, and a three-point linear leveraging configuration to hold said circumferential frame member when said handle member is in a substantially parallel configuration relative to said circumferential frame member.

2. The pool skimming net of claim 1 wherein a cross support member is used for strengthening said circumferential frame member so as to reduce undue warping of said net member.

3. The pool skimming net of claim 1 wherein said retainer member is clipped onto said circumferential frame member by way of a retainer clip member.

4. The pool skimming net of claim 1 wherein said handle member is telescopic.

* * * * *